US006729088B2

(12) United States Patent
Corr

(10) Patent No.: US 6,729,088 B2
(45) Date of Patent: May 4, 2004

(54) POSITIONING JIG FOR INSTALLING MOLDING

(76) Inventor: Shannon L. Corr, 110 Farmstead La., Roswell, GA (US) 30075

( * ) Notice: Subject to any disclaimer, the term of this patent is extended or adjusted under 35 U.S.C. 154(b) by 42 days.

(21) Appl. No.: 10/068,161

(22) Filed: Feb. 5, 2002

(65) Prior Publication Data

US 2003/0145557 A1 Aug. 7, 2003

(51) Int. Cl.[7] ..... E04B 5/00

(52) U.S. Cl. ..... 52/290; 52/211; 52/204.53; 52/287.1; 52/288.1; 52/280; 52/127.2; 52/127.3; 52/127.5; 52/254; 52/555; 52/716.4; 52/716.8; 52/717.05; 52/718.01; 52/445.17; 52/DIG. 1; 81/44; 81/45; 81/485; 33/404; 33/415; 425/458; 15/235.7; 15/235.8; 15/235.3; 15/236.01; 15/236.07; 15/245.1; 15/235.4; 156/60; 156/71

(58) Field of Search ..... 52/287.1, 288.1, 52/280, 290, 127.2, 127.3, 127.5, 254, 555, 716.4, 716.8, 717.05, 718.01, 445.17, DIG. 1, 211, 204.53; 81/45, 44, 485; 33/404, 415; 425/458; 156/60, 71; 15/235.7, 235.8, 235.3, 235.4, 236.01, 236.07, 245.1

(56) References Cited

U.S. PATENT DOCUMENTS

| | | | | | |
|---|---|---|---|---|---|
| 435,845 | A | * | 9/1890 | Marston | 52/287.1 |
| 855,633 | A | * | 6/1907 | Herring | 425/458 |
| 969,528 | A | * | 9/1910 | Disbrow | 30/169 |
| 1,570,177 | A | * | 1/1926 | Pointer | 451/495 |
| 2,181,209 | A | * | 11/1939 | Seeman et al. | 15/235.7 |
| 2,947,017 | A | * | 8/1960 | Dybdahl | 15/235.8 |
| 2,954,649 | A | * | 10/1960 | Carroll et al. | 451/516 |
| 2,981,988 | A | | 5/1961 | Schweitzer | |
| 3,123,947 | A | * | 3/1964 | Rawley | 451/495 |
| 3,129,540 | A | * | 4/1964 | Valles | 451/523 |
| 3,201,910 | A | | 8/1965 | Keesee | |
| 3,341,878 | A | * | 9/1967 | Hubbard | 15/235.4 |
| 3,481,092 | A | | 12/1969 | Constantino | |
| 3,761,992 | A | * | 10/1973 | Schneller | 15/210.1 |
| 3,813,830 | A | * | 6/1974 | Hodge | 451/524 |
| 3,968,191 | A | * | 7/1976 | Stegmeier | 264/34 |
| 4,206,574 | A | * | 6/1980 | Dotsko | 451/495 |
| 4,496,500 | A | * | 1/1985 | Haber | 264/36.22 |
| 4,631,019 | A | * | 12/1986 | House | 425/458 |
| 4,648,225 | A | | 3/1987 | Waddell | |
| 4,669,970 | A | * | 6/1987 | Perry | 425/458 |
| 4,737,097 | A | * | 4/1988 | Cotugno | 425/458 |
| D296,136 | S | | 6/1988 | Dreiling | |
| 5,001,877 | A | * | 3/1991 | Edwards | 52/288.1 |
| 5,125,459 | A | * | 6/1992 | Richards | 172/380 |
| 5,140,784 | A | * | 8/1992 | Walsh | 451/495 |
| 5,199,237 | A | * | 4/1993 | Juntunen | 52/287.1 |
| 5,203,885 | A | * | 4/1993 | Pastre et al. | 51/298 |
| 5,330,262 | A | * | 7/1994 | Peters | 312/140.4 |
| 5,398,469 | A | | 3/1995 | Logan | |
| 5,433,048 | A | | 7/1995 | Strasser | |
| 5,457,923 | A | * | 10/1995 | Logan et al. | 52/288.1 |
| 5,592,797 | A | * | 1/1997 | Logan et al. | 52/288.1 |
| 5,611,102 | A | * | 3/1997 | Lesinsky et al. | 15/235.5 |
| 5,662,753 | A | | 9/1997 | Loos | |

(List continued on next page.)

*Primary Examiner*—Carl D. Friedman
*Assistant Examiner*—Christy Green
(74) *Attorney, Agent, or Firm*—Gardner Groff, P.C.

(57) ABSTRACT

A jig adapted for easily positioning, properly orienting and installing a molding. The jig includes a body having a positioning portion configured to receive a molding. The body also includes a first positioning margin and a second positioning margin each emanating from the positioning portion, the positioning margins being configured so as to be substantially perpendicular to each other. The jig facilitates placement of the molding at a proper installation angle at a juncture of two surfaces, such as a ceiling and wall.

20 Claims, 3 Drawing Sheets

U.S. PATENT DOCUMENTS 5,688,016 A 11/1997 Gold
D390,762 S * 2/1998 Douglas ..... D8/13
5,802,790 A * 9/1998 Lamont et al. ..... 52/288.1
5,819,485 A 10/1998 Lane et al.
5,850,717 A * 12/1998 Schiedegger et al. ..... 52/288.1
5,918,435 A 7/1999 McGowen
5,941,046 A 8/1999 Prather
6,003,192 A * 12/1999 Ciminise et al. ..... 15/235.5
6,112,481 A * 9/2000 Schiedegger et al. ..... 52/211
6,115,982 A 9/2000 Lindenberg
6,120,365 A * 9/2000 Johnson ..... 451/495
6,129,869 A * 10/2000 Stegmeier et al. ..... 264/35
6,145,259 A * 11/2000 Koenig et al. ..... 52/287.1
6,228,507 B1 5/2001 Hahn
6,253,510 B1 * 7/2001 Santarossa ..... 52/287.1
6,260,249 B1 7/2001 Collins
6,318,039 B1 11/2001 Watson et al.
6,439,983 B1 * 8/2002 McCoy et al. ..... 451/354
6,481,170 B1 * 11/2002 Savenok et al. ..... 52/288.1

* cited by examiner

POSITIONING JIG FOR INSTALLING MOLDING

FIELD OF THE INVENTION

The present invention is directed to devices and methods for installing molding.

BACKGROUND OF THE INVENTION

As popularity of do-it-yourself home improvement grows, so does a need for providing simple tools by which the do-it-yourselfer can accomplish tasks that have taken skilled craftsmen years of training and practice to master.

Installation of molding, particularly that molding commonly referred to as crown molding, can be a difficult and time-consuming task. Such molding is typically installed at the junction of perpendicularly-disposed surfaces, such as wallboard sheets, which are arranged in mutually-abutting relation. A typical installation of such molding is at the junction of a wall to a ceiling.

As shown for instance in FIG. 1, contacting surfaces 40 on a piece of molding 30, (the surfaces that should fit flush with the wall 34 and ceiling 32 surfaces, for proper installation), are typically very small surfaces, and it is difficult to ascertain when these contacting surfaces are flat against their respective wall and ceiling surface.

Further, another difficulty encountered by the installer relates to the inefficiency of the human eye to distinguish between slightly varying angles. For instance, the human eye is typically not capable of distinguishing between a 45 degree angle and a 38 degree angle. When the molding is not installed at the proper angle, gaps will be formed, (see FIG. 1), and must be caulked or sealed to attempt to compensate for the improper installation and the resulting unappealing look.

It is difficult to install the crown molding at the correct angle such that there is no overlap or gaps between the molding edges and the surfaces to which it is attached. Further, such moldings are difficult to install because the task is usually performed over the head of the installer, making it difficult both physically and visually (to achieve the proper angle of installation).

Further, it is difficult for a person working alone to install crown molding since it is not uncommon for the piece of molding to be as much as 10 feet in length. Typically, one installer holds an end of the molding, while another holds the opposite end, as the molding is both properly positioned and attached to the perpendicular surfaces by that individual. What is needed is a device designed to facilitate one-person installation.

The present invention avoids these and other difficulties by providing devices and methods for easily positioning, properly orienting and installing a molding.

SUMMARY OF THE INVENTION

Briefly described, in one embodiment of the invention, a positioning jig is used for accurately positioning a piece of molding during installation of the molding. The positioning jig includes a body having first and second reference surfaces that are substantially perpendicular to each other. The body also includes a molding-cradling recess for cradling and positioning the molding in a predetermined orientation relative to the first and second reference surfaces.

Optionally, the body includes a handle, and the body is panel-shaped. Also, the molding-cradling recess can be formed to match the cross-sectional profile, (or a part thereof), of the molding. Further, the recess can be provided with a resilient face. Yet another embodiment includes that the jig can include a second body, spaced from the first, the bodies ganged together.

Stated another way, the present invention is a jig adapted for positioning, properly orienting and installing a molding. More particularly, the jig includes at least one body having a positioning portion configured to receive a molding. The body also includes a first positioning margin and a second positioning margin each emanating from the positioning portion, the positioning margins being configured so as to be substantially perpendicular to each other. The jig facilitates placement of the molding at a proper installation angle at a juncture of two surfaces, such as a ceiling and wall. It is contemplated that use of multiple bodies to form the positioning jig will facilitate one-person installation.

The positioning jig can conveniently include a handle attached to the body or formed integrally with the body.

The positioning portion of the jig can further be configured to have a contoured shape corresponding to a profile of the molding and is typically recessed to receive the molding.

The positioning jig can also include a deformable portion configured to receive multiple molding profiles. As such, the deformable portion can be formed from an impressionable material, such that the jig will accommodate profiles of different moldings.

In use, the molding is placed in the molding-cradling recess or positioning portion, and the body is pushed into the ceiling-to-wall juncture (corner) until the perpendicular reference surfaces or positioning margins are pushed against the ceiling and the adjacent wall. With the jig thus "seated", the position and angular orientation of the molding relative to the ceiling and the wall are consistently fixed. This makes it easy and time-efficient to correctly position the molding for accurate installation.

That the invention improves over the prior art and accomplishes the advantages described above will become apparent from the following detailed description of the exemplary embodiments and the appended drawings and claims.

BRIEF DESCRIPTION OF THE DRAWINGS

As used herein, like numerals throughout the various figures represent the same or equivalent features of the present invention.

DETAILED DESCRIPTION OF THE PREFERRED EMBODIMENT

The present invention provides a jig adapted for easily positioning, properly orienting and installing a molding. A jig is a device used as a guiding tool or for holding an article in place while something else is done to the article. As used herein, a molding is an embellishment in strip form, made of wood or other structural material, which is used to decorate or finish a surface, such as the wall of a room or building or the surface of a door or piece of furniture.

Exemplary of an article that can be installed using the positioning jig according to the present invention includes a molding for installation in a room space, for instance along the juncture of a ceiling and a wall.

Figure 1:
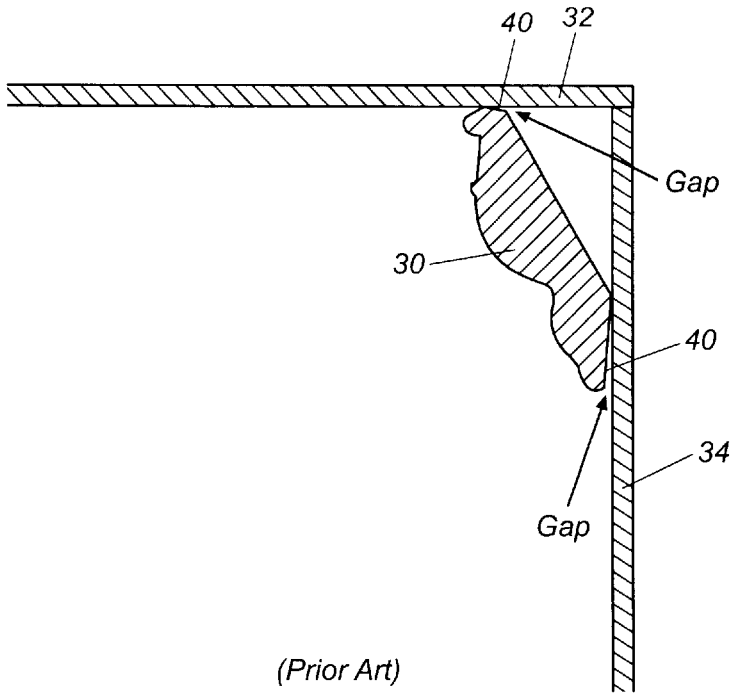
(Prior Art) Fig. 1
FIG. 1 is a side view of improper installation of a molding according to the prior art.
Figure 2A:
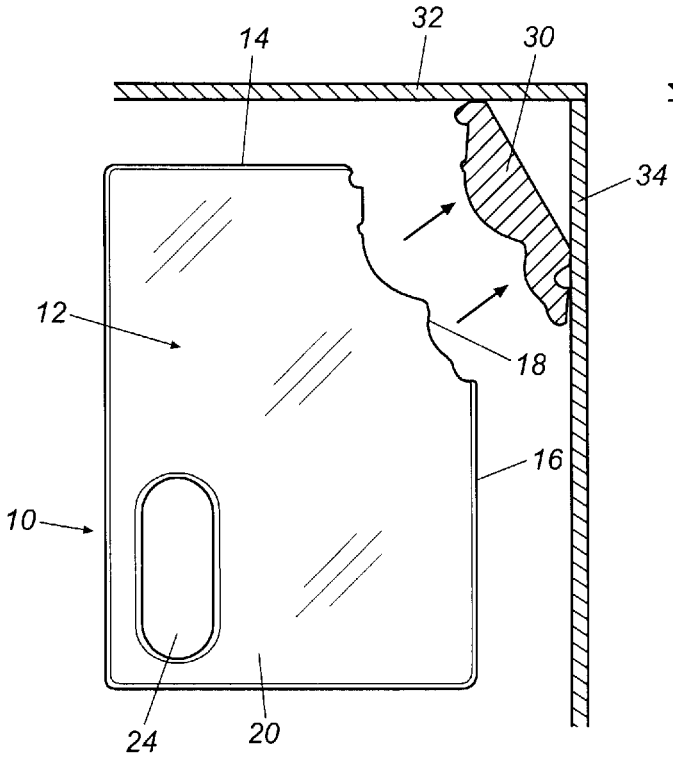
FIGS. 2*a* and 2*b* are side views of a positioning jig according to one embodiment of the present invention.

With reference to FIG. 2*a*, the positioning jig 10 according to one embodiment of the present invention includes a body 12. The body 12 can be formed in any shape, and is shown in FIG. 2*a* as panel-shaped. The body 12 has a molding-cradling recess or positioning portion 18, which is configured to receive a molding 30, to cradle or hold the molding. The body 12 also includes a first reference surface or first positioning margin 14 and a second reference surface or second positioning margin 16 each emanating from the positioning portion 18.

The positioning margins 14 and 16 are configured so as to be substantially perpendicular to each other and are longitudinally-extending to provide ample surface-to-surface contact with a first surface or wall 34 and a second surface or ceiling 32. The jig further positions the molding in a predetermined orientation relative to the first and second positioning margins.

Figure 2B:
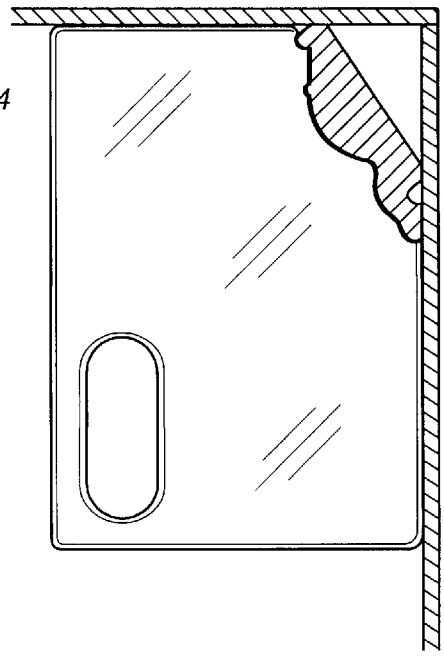

In use, the positioning portion 18 of the body 10 is configured to receive the molding 30, as shown for instance in FIG. 2*b*, for placement of the molding at the juncture of the ceiling 32 and the wall 34. When the molding 30 is seated within the positioning portion 18, it is placed into the juncture of the ceiling 32 and the wall 34 and the positioning margins 14 and 16 will contact the ceiling and wall, thus positioning the molding adjacent to the wall and ceiling at the proper angle of installation. The installation can then be completed by attaching the molding to the junction using fasteners or other methods known by those of ordinary skill in the art.

Figure 3:
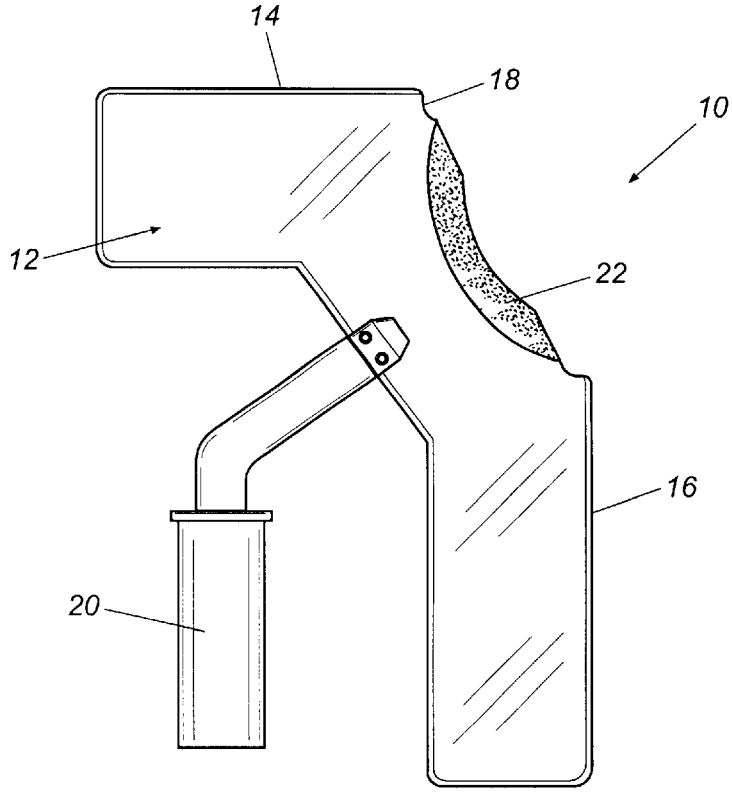
FIG. 3 is a side view of the positioning jig according to another embodiment of the present invention.

The positioning jig 10 will conveniently include a handle 20 as shown in FIGS. 2 and 3. As shown herein, the handle 20 can be attached to the body 12 (FIG. 3), or can be formed integrally with the body (FIG. 2*a*). Also, the handle 20, or other portion of the body 12, can include an opening or hole 24. The opening 24 can serve multiple roles such as facilitating easy grasping of the body, and also providing a mechanism by which the positioning jig can be hung on a wall during storage.

The positioning portion 18 is configured to receive a molding 30. Such configuration can include that the positioning portion 18 have a contour substantially matching a cross-sectional profile of the molding 30 to be installed, as shown in FIG. 2. The positioning portion 18 is typically recessed to receive the molding 30, and can also be at least semi-arcuately shaped, meaning that the positioning portion is bent or curved in the form of a bow.

The positioning portion 18 can also include a resilient face or deformable portion 22, as shown for instance in FIG. 3, either attached to or formed integral with the positioning portion, in such a way that the deformable portion can receive multiple molding profiles.

The deformable portion 22 can be formed from an impressionable material, such that the jig will accommodate profiles of different moldings. Such impressionable materials include, but are not limited to, plastic deformable materials, foams, and wax-type materials.

It is further contemplated herein that the positioning portion 18 and/or the deformable portion 22 can be detachable and replaceable. In other words, these portions can be constructed such that multiple portions can be made to fit a single handle.

Figure 4:
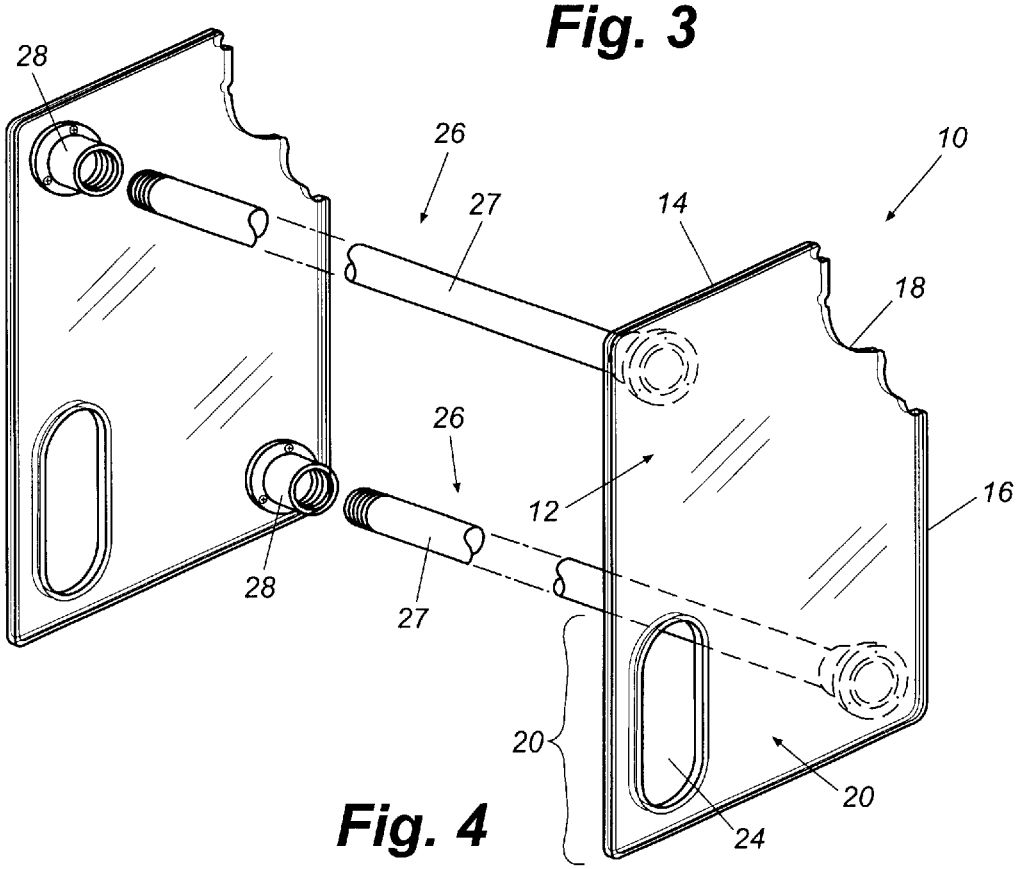
FIG. 4 is a perspective view of a positioning jig having more than one body according to another embodiment of the present invention.

The positioning jig 10 according to the present invention can also include a plurality of bodies 20 configured in series as shown in FIG. 4. In other words, another or second body can be spaced from the first body, ganged together. Such an arrangement will facilitate one-person installation.

Turning again to FIG. 4, at least one connecting mechanism 26 can be used to connect the multiple bodies 20. As shown in FIG. 4, two such connecting mechanisms 26 can be configured with a member 27 attached at either end 28 of the mechanism to a side of the body 12 of the jig 10. Although the figure only shows two bodies attached, it will be understood that more than two bodies can be similarly attached to a connecting mechanism or ganged.

The connecting mechanism 26 can be supplied in various lengths, or conversely be length-variable itself, so that the span between the bodies 12 can be adjustable. It is contemplated herein that a typical length of each connecting mechanism 26 be about 3–24 inches in length, although other lengths can also be used. Further, although the members 27 are shown in a rod-form, it will be understood that any mostly rigid material can be used to form the member. It is also contemplated that although FIG. 4 shows the members 27 being attached to the body 12 using a screw-type fastener, any fastener known by those of ordinary skill in the art would suffice. In fact, the entire multiple-bodied positioning jig can be formed using any type of molding process.

Figure 5:
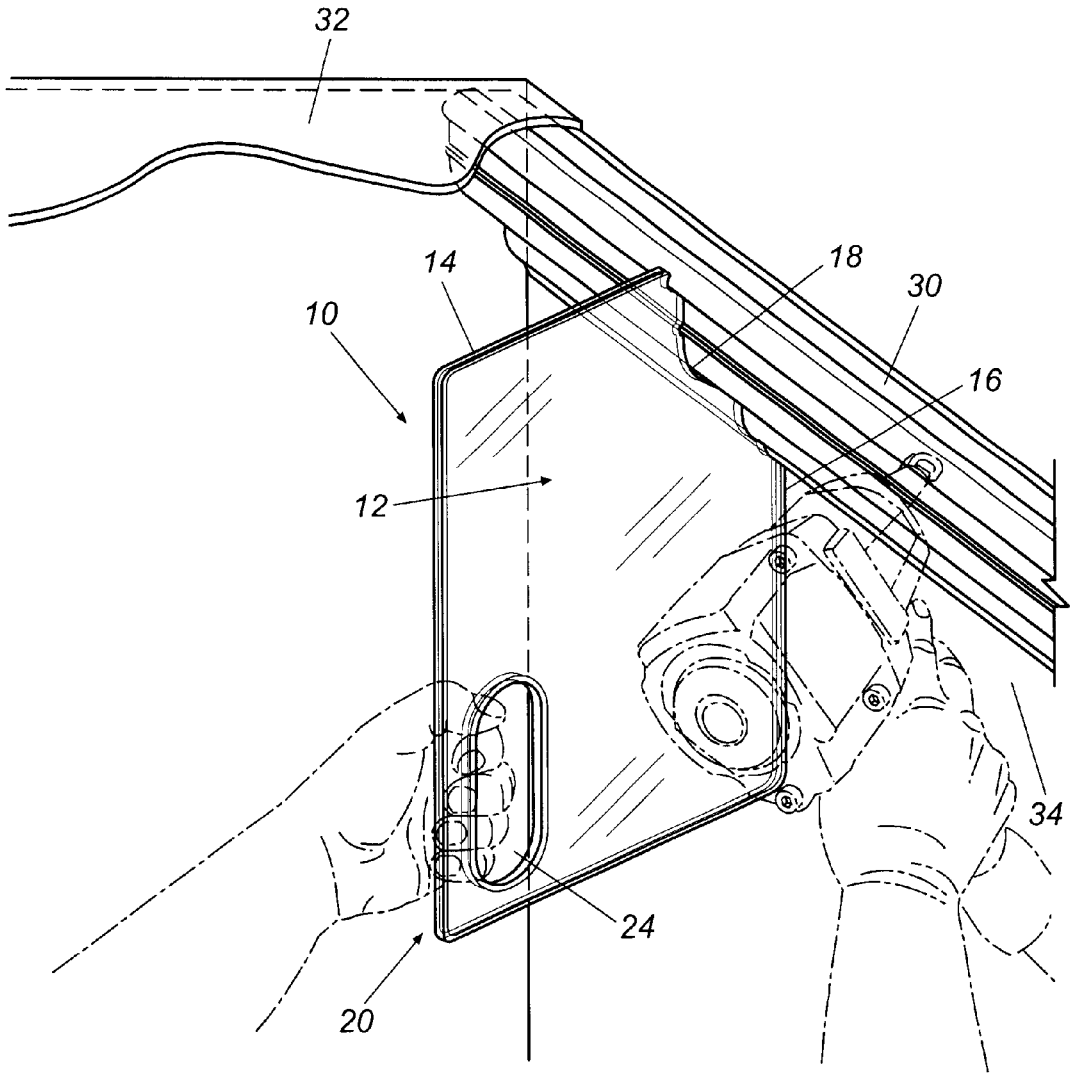
FIG. 5 is a perspective view of installation of a molding using a positioning jig according to one embodiment of the present invention.

Turning to FIG. 5, the molding 30 is placed in the positioning portion 18 of the jig 10, and the body 12 is pushed into the ceiling-to-wall juncture (corner) until the positioning margins 14 and 16 are pushed against the ceiling 32 and the adjacent wall 34. With the jig thus "seated", the position and angular orientation of the molding relative to the ceiling and the wall are consistently fixed. This makes it easy and time-efficient to correctly position the molding for accurate installation.

The terms and expressions which have been employed herein are used as terms of description and not of limitation, and there is no intention, in the use of such terms and expressions, of excluding any equivalents of the features shown and described or portions thereof. Having thus described the invention in detail, it should be apparent that various modifications can be made in the present invention without departing from the spirit and scope of the following claims.

I claim:

1. A positioning jig for positioning crown molding during installation of the molding, comprising:

a body having a first reference surface and a second reference surface which is substantially perpendicular to said first reference surface, said body including a molding-cradling recess defining a juncture between proximal ends of the first and second reference surfaces for receiving the molding therein and holding the molding at a predetermined orientation relative to said first and second reference surfaces.

2. The positioning jig of claim 1 wherein said molding-cradling recess has a contour substantially matching a cross-sectional profile of the molding to be installed.

3. The positioning jig of claim 1 wherein said body includes a handle.

4. The positioning jig of claim 3 wherein said handle comprises an opening formed in said body.

5. The positioning jig of claim 1 wherein said molding-cradling recess holds the molding at a predetermined angle relative to said first and second reference surfaces.

6. The positioning jig of claim 1 wherein said body is panel-like.

7. The positioning jig of claim 1 further comprising a second body ganged to said first body, said second body also including perpendicular reference surfaces and a molding-cradling recess.

8. A positioning jig for properly orienting and installing crown molding comprising:

a) a body having a first positioning margin and a second positioning margin, said second positioning margin being substantially perpendicular to said first positioning margin; and b) a positioning portion defining a juncture between proximal ends of said first and second positioning margins, and configured to receive the molding.

9. The positioning jig of claim 8 wherein a handle is attached to said body.

10. The positioning jig of claim 8 wherein a handle is formed integrally with said body.

11. The positioning jig of claim 8 wherein said positioning portion has a contoured shape corresponding to a profile of the molding.

12. The positioning jig of claim 8 wherein said positioning portion is detachable and replaceable on said body.

13. The positioning jig of claim 8 wherein said positioning portion is recessed to receive the molding and at least semi-arcuately shaped.

14. The positioning jig of claim 8 further comprising a deformable portion integral with said positioning portion, said deformable portion being configured to receive multiple molding profiles.

15. The positioning jig of claim 14 wherein said deformable portion is formed from an impressionable material.

16. The positioning jig of claim 14 wherein said deformable portion is a plastic deformable material.

17. The positioning jig of claim 14 wherein said deformable portion is a wax-type material.

18. The positioning jig of claim 8 further comprising a second body, spaced from said first body and coupled together.

19. A positioning jig for properly orienting and installing crown molding comprising:

a) a plurality of bodies; each of said bodies having a first positioning margin, a positioning portion, and a second positioning margin; said first margin and said second margin emanating from said positioning portion, said second margin further being substantially perpendicular to said first margin;

b) said positioning portion being configured to receive the molding; and c) at least one connecting mechanism configured to connect said plurality of bodies.

20. The positioning jig of claim 19 wherein said connecting mechanism is length adjustable.

* * * * *